US010165864B1

(12) United States Patent
Su

(10) Patent No.: US 10,165,864 B1
(45) Date of Patent: Jan. 1, 2019

(54) CHAIR ARMREST DEVICE

(71) Applicant: Tung-Hua Su, Tainan (TW)

(72) Inventor: Tung-Hua Su, Tainan (TW)

( * ) Notice: Subject to any disclaimer, the term of this patent is extended or adjusted under 35 U.S.C. 154(b) by 25 days.

(21) Appl. No.: 15/624,733

(22) Filed: Jun. 16, 2017

(51) Int. Cl.
*A47C 7/54* (2006.01)

(52) U.S. Cl.
CPC ..... *A47C 7/54* (2013.01); *A47C 7/541* (2018.08)

(58) Field of Classification Search
CPC ..... A47C 7/54; A47C 7/541; A47C 1/0303; A47C 1/0305
See application file for complete search history.

(56) References Cited

U.S. PATENT DOCUMENTS 5,664,842 A * 9/1997 Tseng ..... A47C 1/03 297/353
6,540,300 B2 * 4/2003 Piretti ..... A47C 1/03 297/411.35
6,702,386 B2 * 3/2004 Davis ..... A47C 7/54 297/411.35
6,755,473 B2 * 6/2004 Reed ..... A47C 1/03 297/344.19
6,824,217 B1 * 11/2004 Wang ..... B60N 2/77 297/411.36
6,840,582 B2 * 1/2005 Burwell ..... A47C 7/38 297/411.36
7,011,371 B1 * 3/2006 Tsai ..... A47C 1/03 297/353
8,128,172 B2 * 3/2012 Tsai ..... A47C 1/03 297/411.36
9,044,093 B1 * 6/2015 Pan ..... A47C 1/03
9,848,707 B1 * 12/2017 Cassaday ..... F16B 7/1418
D816,381 S * 5/2018 Su ..... D6/716.2
2015/0130250 A1 * 5/2015 Masunaga ..... A47C 1/03 297/411.36
2016/0088946 A1 * 3/2016 Bock ..... A47C 7/54 297/411.36

* cited by examiner

*Primary Examiner* — Philip F Gabler
(74) *Attorney, Agent, or Firm* — Alan D. Kamrath; Kamrath IP Lawfirm, P.A.

(57) ABSTRACT

A chair armrest device includes a main frame and an outer sleeve coupled to the main frame. The outer sleeve includes an insertion portion having a plurality of positioning grooves. A cover is mounted on top of the outer sleeve. An inner sleeve includes a shank inserted into the insertion portion of the shank. An actuating rod is pivotably received in the inner sleeve. A positioning peg is provided on the actuating rod for releasably engaging with one of the positioning grooves. A guiding peg is provided on the actuating rod and is received in an inclined guiding groove of a button. A pad is mounted on top of the inner sleeve and is pivotable relative to the main frame. The button can be pressed to pivot the actuating rod to thereby disengage the positioning peg from the positioning groove for adjusting a height of the pad.

10 Claims, 11 Drawing Sheets

A-A

B-B

C-C

CHAIR ARMREST DEVICE

BACKGROUND OF THE INVENTION

The present invention relates to a chair armrest device and, more particularly, to a chair armrest device permitting reliable adjustment in the height and the angular position of a pad.

Chairs are necessary furniture in human life. Two armrests are provided on two sides of a seat of a chair to support the elbows or the forearms of the user to thereby increase sitting comfort.

Conventional armrests have different structures. In a simple structure, the heights of the armrests cannot be adjusted after having been mounted to two sides of the seat and, thus, cannot suit users of different heights, providing poor applicability and poor supporting comfort.

To solve the above disadvantages, an armrest permitting adjustment in the height is proposed and includes a telescopic rod below a pad. A knob is turned to position the telescopic rod after the desired height is reached. However, turning of the knob is inconvenient, and the armrest cannot be retained in the desired height if the knob is not tightened.

Furthermore, the angular position of the pads of conventional armrests cannot be adjusted, causing friction between the skin of the hand of the user and the pad during use of a mouse or other conditions requiring movement of the arm of the user.

Thus, a need exists for a novel chair armrest device that mitigates and/or obviates the above disadvantages.

BRIEF SUMMARY OF THE INVENTION

The primary objective of the present invention is to provide a chair armrest device permitting easy adjustment and positioning of the pad in the desired height.

Another objective of the present invention is to provide a chair armrest device permitting pivotal movement of the pad of the chair armrest device within a predetermined angular range.

A chair armrest device according to the present invention includes a main frame including an upper end having a first coupling portion and a lower end having a second coupling portion. An outer sleeve includes a third coupling portion and an insertion portion. The third coupling portion is coupled to the first coupling portion. The insertion portion includes an insertion groove extending in a vertical direction. A positioning portion is disposed in the insertion groove and extends in the vertical direction. The positioning portion includes a plurality of positioning grooves spaced from each other in the vertical direction. The insertion portion further includes a passage located at a side of the positioning portion and extending in the vertical direction. A cover is mounted above the outer sleeve. The cover includes a top wall and a peripheral wall extending downward along a periphery of the top wall. The top wall includes a through-hole aligned with the insertion groove of the outer sleeve. The outer cover further includes a stopper for blocking the opening of the passage of the outer cover. An inner sleeve includes a shank at a lower end thereof. The shank is received in the insertion groove of the outer sleeve. A fourth coupling portion is disposed on top of the shank. The shank includes an annular wall and a bottom wall. The shank further includes a first compartment in a central portion thereof. The annular wall of the shank includes a slot. The fourth compartment includes a second compartment. A control device includes a coupling board, an actuating rod, a button, and an elastic element. The coupling board is fixed in the second compartment. The actuating rod extends in the vertical direction and is pivotably received in the first compartment of the inner sleeve. The actuating rod includes a rectilinear rod portion having a lower portion and an upper portion. A positioning peg is formed on the lower portion of the rectilinear rod portion and extends through the slot of the shank of the inner sleeve for releasably engaging with one of the plurality of positioning grooves. A guiding peg is formed on the upper portion of the rectilinear rod portion. The button includes a pivotal hole pivotably connected to the coupling board. The button includes a guiding portion and a pressing portion. The guiding portion includes an inclined guiding groove through which the guiding peg extends. The elastic element provides the button with operational elasticity. A pad is mounted above the fourth coupling portion of the inner sleeve. When the pressing portion is not pressed, the positioning member is received in one of the plurality of positioning grooves. When the pressing portion is pressed, the guiding portion actuates the actuating rod to pivot, and the positioning peg is moved into the passage of the outer sleeve, permitting adjustment of a height of the pad.

In an example, the positioning portion of the outer sleeve includes a positioning plate. The plurality of positioning grooves is disposed in the positioning plate. The positioning plate and the positioning peg are formed by rigid metal.

In an example, the positioning portion of the outer sleeve includes two parallel strips extending from an inner wall of the insertion groove toward a center of the insertion groove. Lower ends of the two parallel strips are connected by a connecting plate to form a coupling groove at the lower ends of the two parallel strips. The positioning board is sandwiched between the two parallel strips and includes a lower end positioned in the coupling groove.

In an example, the actuating rod is made of plastic, and the positioning peg made of metal is integrally formed with the actuating rod.

In an example, the insertion portion of the outer sleeve includes a connecting hole in communication with an upper portion of the passage. The peripheral wall of the cover includes a connecting hole aligned with the connecting hole of the outer sleeve. The stopper extends into the opening of the passage. The stopper includes a connecting hole aligned with the connecting hole of the outer cover. The cover is mounted on top of the outer sleeve. A fixing member extends through the connecting hole of the insertion portion of the outer sleeve, the connecting hole of the peripheral wall of the cover, and the connecting hole of the stopper.

In an example, the bottom wall of the shank of the inner sleeve includes an axial hole. The coupling board includes an axial hole. The upper portion of the rectilinear rod portion of the actuating rod includes a reduced end having a connecting hole in a central portion thereof. The rectilinear rod portion further includes an axial hole in a central portion of a lower end thereof. The reduced end extends through the axial hole of the coupling board. A connecting member is securely engaged in the connecting hole of the reduced end. The axial hole of the lower end of the rectilinear rod portion is aligned with the axial hole of the inner sleeve and is pivotably connected by a pin.

In an example, the coupling board includes two parallel pivotal pieces having pivotal holes. The coupling board further includes a mounting seat. The pivotal hole of the button is pivotably connected to the pivotal holes of the pivotal pieces of the coupling board. The pressing portion includes a receiving groove. The elastic element is a compression spring having two ends respectively mounted in the receiving groove of the pressing portion and the mounting seat of the coupling board.

In an example, the first compartment of the shank of the inner sleeve includes an upper opening. The fourth coupling portion is disposed on top of the shank and includes a bottom wall and an annular wall. The fourth coupling portion further includes an upper opening. The second compartment is located between the bottom wall and the annular wall. The bottom wall includes a through-groove aligned with the upper opening of the shank. The bottom wall further includes a through-hole at a side of the through-groove. The pressing portion of the button extends through the through-hole of the bottom wall.

In an example, the first coupling portion of the main frame includes a vertical sidewall. The vertical sidewall includes a first upper pivotal plate and a first lower pivotal plate below and parallel to the first upper pivotal plate. The first upper pivotal plate includes a first pivotal hole in a central portion thereof. The first lower pivotal plate includes a second pivotal hole in a central portion thereof. The first upper pivotal plate includes an upper side having a limiting groove. The limiting groove includes two stop walls on two sides thereof. A stopper portion protrudes from the vertical sidewall for limiting an outward pivotal angle. The outer sleeve further includes a second upper pivotal plate above the first upper pivotal plate of the main frame. The outer sleeve further includes a second lower pivotal plate above the first lower pivotal plate of the main frame. The second upper pivotal portion includes a third pivotal hole in a central portion thereof. The second lower pivotal portion includes a fourth pivotal hole in a central portion thereof. The second upper pivotal plate includes an upper side having a polygonal groove aligned with the third pivotal hole. The second upper pivotal plate further includes a lower side inserted into the limiting groove. A limiting block is formed on the lower side of the second upper pivotal plate and is movable in the limiting groove. The second lower pivotal plate includes a periphery having an abutment portion for abutting the stopper portion of the main frame. The second upper pivotal plate and the second lower pivotal plate are respectively above the first upper pivotal plate and the first lower pivotal plate. A nut is mounted in the polygonal groove in the upper side of the second upper pivotal plate. An axle extends through the second pivotal hole, the fourth pivotal hole, the first pivotal hole, and the third pivotal hole and engages with the nut. The outer sleeve is pivotable relative to the main frame. The limiting block abuts against the first stop wall of the limiting groove to limit an inward pivotal angle of the outer sleeve. The limiting block abuts against the second stop wall of the limiting groove, and the abutment portion abuts the stopper portion, thereby limiting an outward pivotal angle of the outer sleeve.

In an example, the upper side of the second upper pivotal plate of the outer sleeve further includes a recessed portion located at a side of the polygonal groove. The top wall of the cover includes a through-hole aligned with the polygonal groove of the second upper pivotal plate. The cover further includes a tab extending downward and aligned with the recessed portion. The cover further includes a pressing plate extending horizontally from a lower end of the tab. The nut presses against the pressing plate.

The present invention will become clearer in light of the following detailed description of illustrative embodiments of this invention described in connection with the drawings.

DETAILED DESCRIPTION OF THE INVENTION

Figure 1:
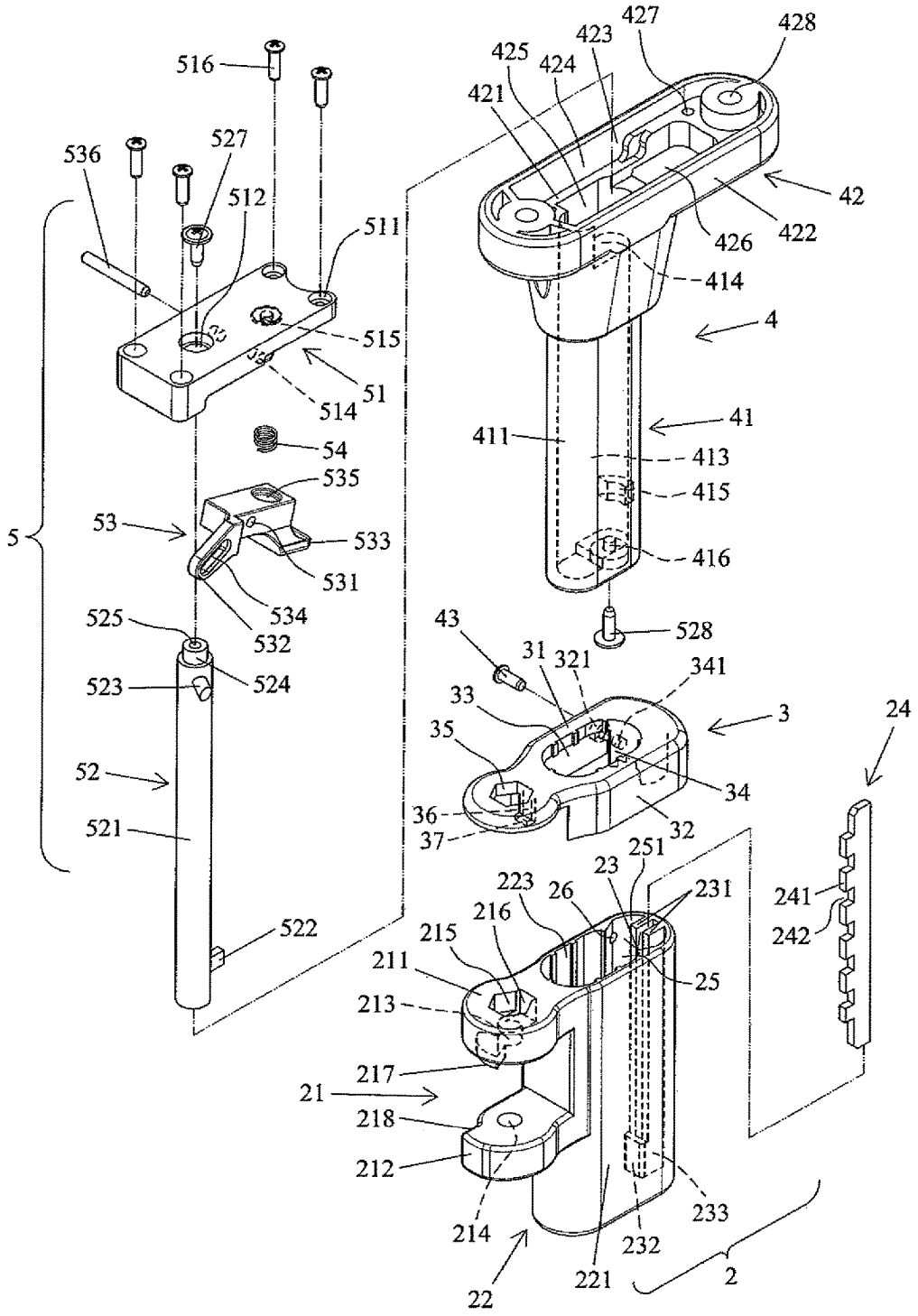
FIG. 1 is a partial, exploded, perspective view of a chair armrest device according to the present invention.
Figure 2:
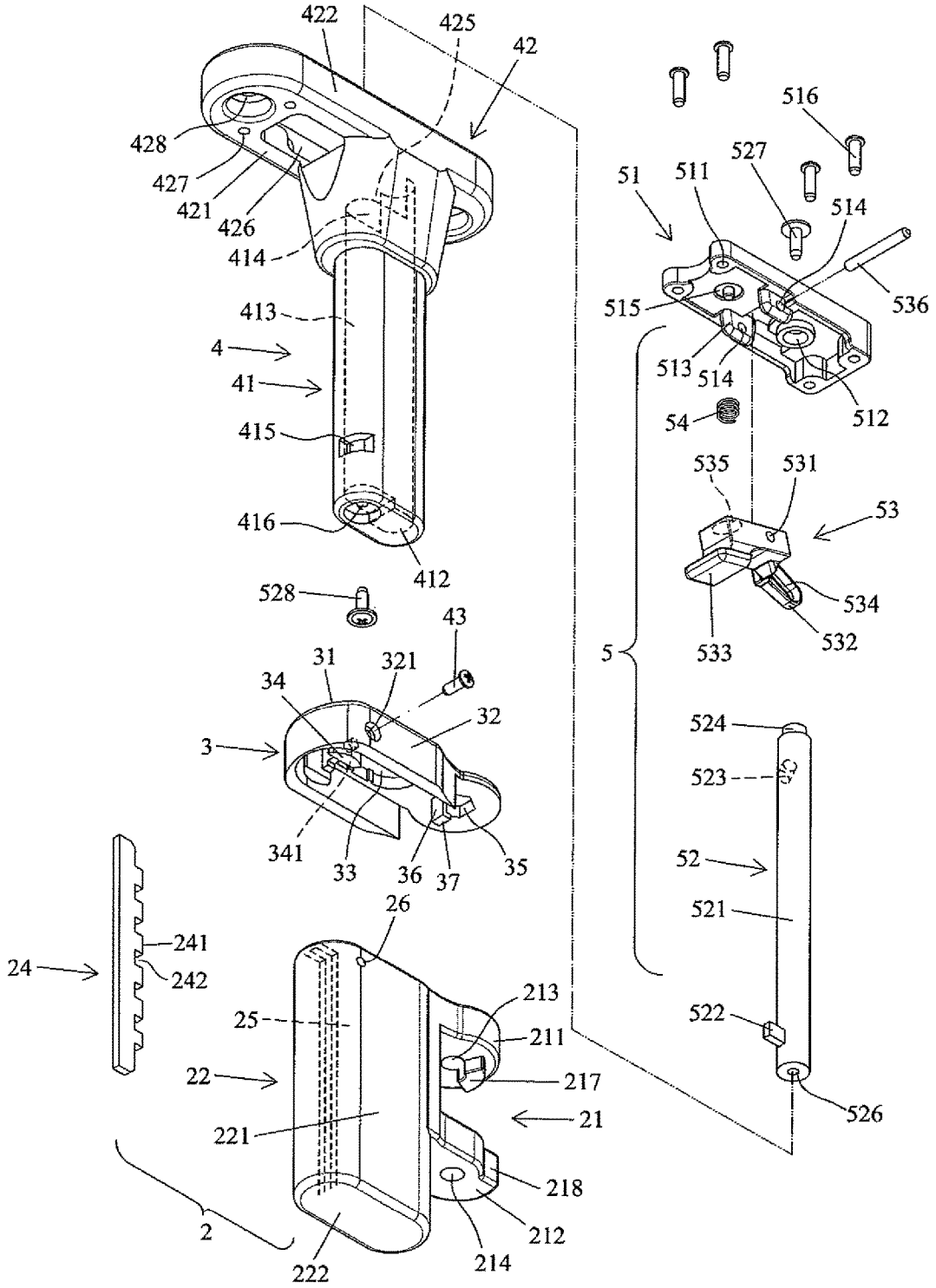
FIG. 2 is another partial, exploded, perspective view of the chair armrest device of FIG. 1.
Figure 3:
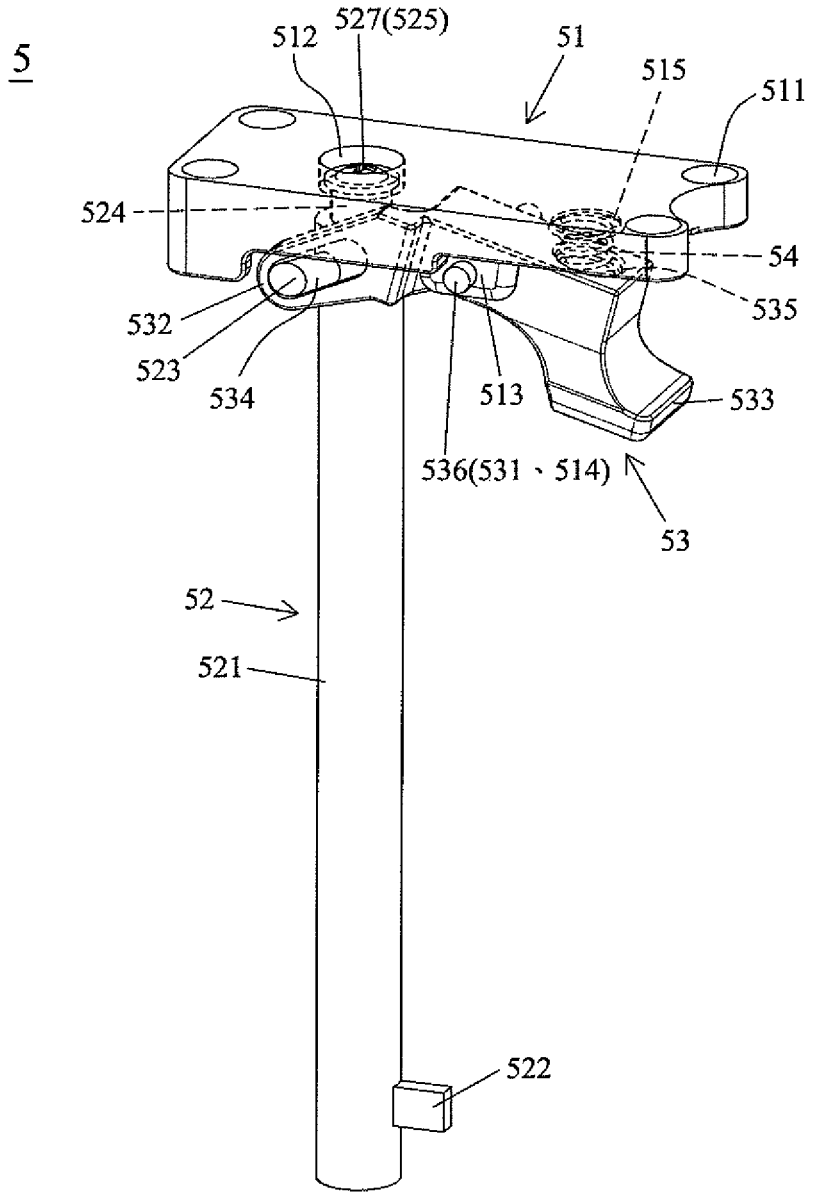
FIG. 3 is a perspective view of a control device of the chair armrest device of FIG. 1.
Figure 4:
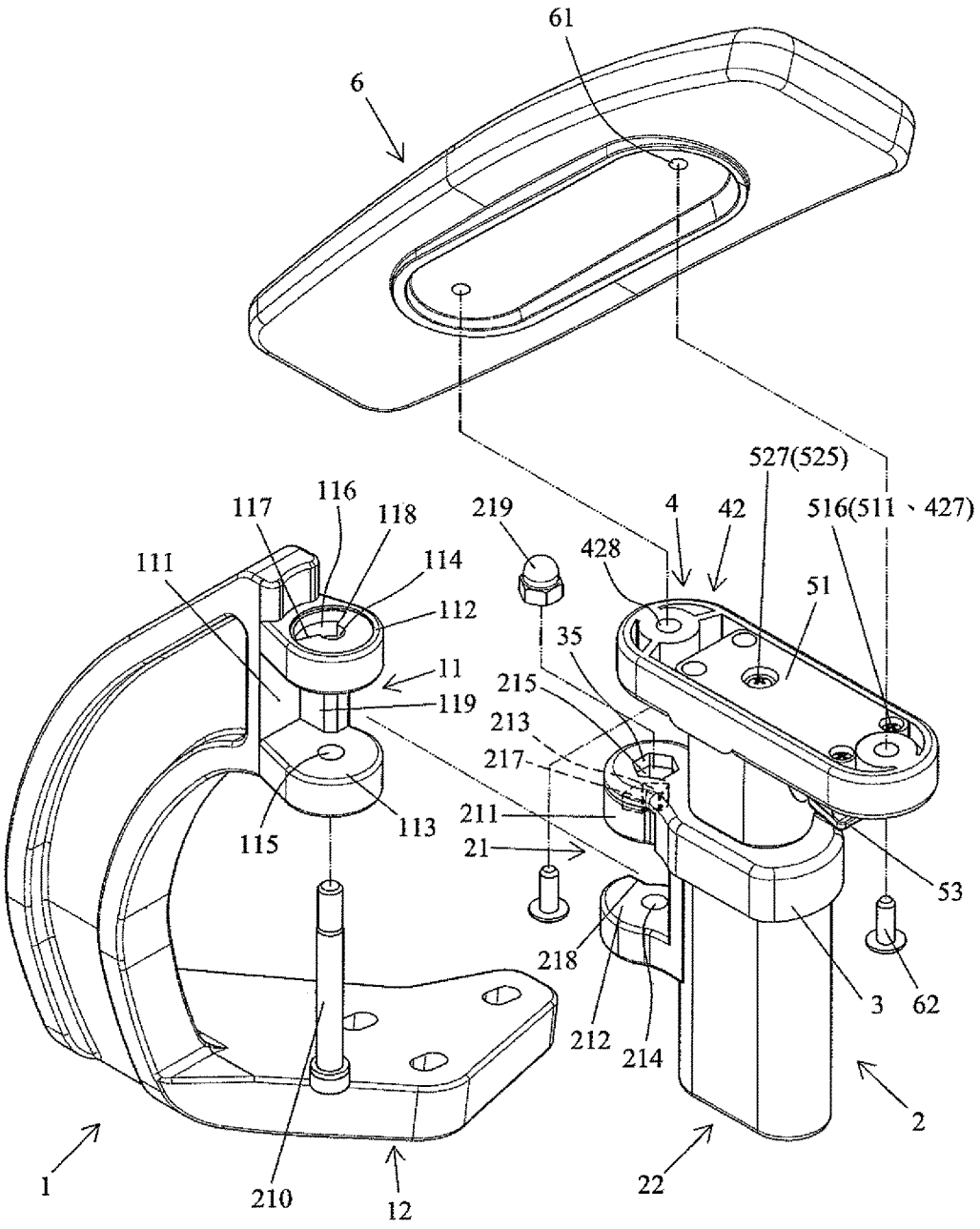
FIG. 4 is an exploded, perspective view of the chair armrest device according to the present invention.
Figure 5:
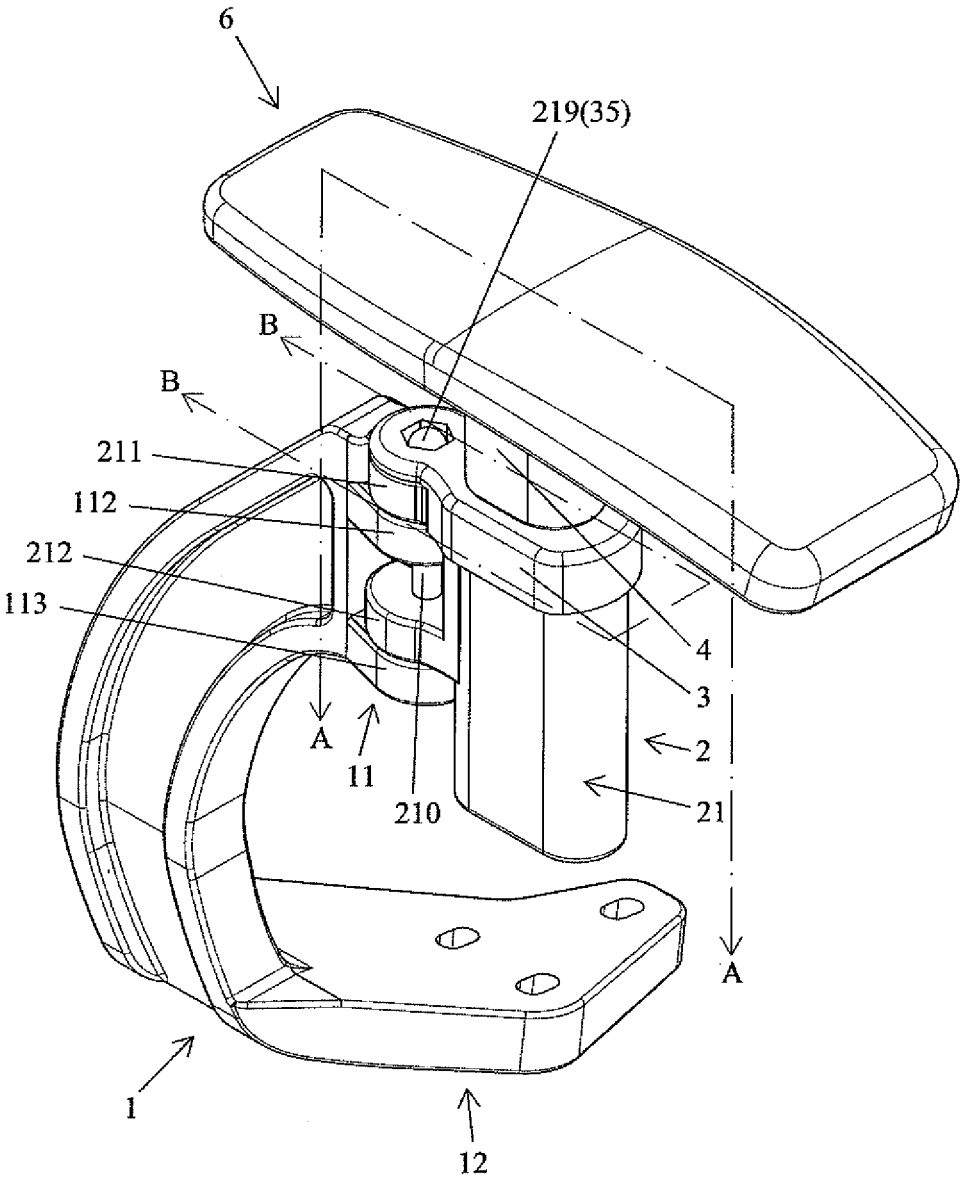
FIG. 5 is a perspective view of the chair armrest device of FIG. 4.

With reference to FIGS. 1-11, a chair armrest device according to the present invention includes a main frame 1, an outer sleeve 2, a cover 3, an inner sleeve 4, a control device 5, and a pad 6. With reference to FIGS. 1, 2, and 4, the main frame 1 includes an upper end having a first coupling portion 11. The first coupling portion 11 includes a vertical sidewall 111 having a first upper pivotal plate 112 and a first lower pivotal plate 113 below and parallel to the first upper pivotal plate 112. The first upper pivotal plate 112 includes a first pivotal hole 114 in a central portion thereof. The first lower pivotal plate 113 includes a second pivotal hole 115 in a central portion thereof. The first upper pivotal plate 112 includes an upper side having a limiting groove 116. The limiting groove 116 includes two stop walls 117 and 118 on two sides thereof for limiting inward and outer pivotal angles, respectively. A stopper portion 119 protrudes from the vertical sidewall 111 for limiting the outward pivotal angle. The main frame 1 further includes a lower end having a second coupling portion 12 for coupling with a seat (not shown) of a chair.

With reference to FIGS. 1, 2, 4, 5, and 11, the outer sleeve 2 is mounted to the first coupling portion 11 and includes a third coupling portion 21 and an insertion portion 22. The third coupling portion 21 is disposed on a side of the insertion portion 22 and includes a second upper pivotal plate 211 above the first upper pivotal plate 112 of the main frame 1 and a second lower pivotal plate 212 above the first lower pivotal plate 113 of the main frame 1. The second upper pivotal portion 211 includes a third pivotal hole 213 in a central portion thereof. The second lower pivotal portion 212 includes a fourth pivotal hole 214 in a central portion thereof. The second upper pivotal plate 211 includes an upper side having a polygonal groove 215 aligned with the third pivotal hole 213. The upper side of the second upper pivotal plate 211 of the outer sleeve 2 further includes a recessed portion 216 at a side of the polygonal groove 215. The second upper pivotal plate 211 further includes a lower side inserted into the limiting groove 116. A limiting block 217 is formed on the lower side of the second upper pivotal plate 211 and is movable in the limiting groove 116. The second lower pivotal plate 212 includes a periphery having an abutment portion 218 for abutting against the stopper portion 119 of the main frame 1.

The second upper pivotal plate 211 and the second lower pivotal plate 212 are respectively above the first upper pivotal plate 112 and the first lower pivotal plate 113. A nut 219 is mounted in the polygonal groove 215 in the upper side of the second upper pivotal plate 211. An axle 210 extends through the second pivotal hole 115, the fourth pivotal hole 214, the first pivotal hole 114, and the third pivotal hole 213 and engages with the nut 219. The outer sleeve 2 is pivotable relative to the main frame 1. The limiting block 217 can abut against the first stop wall 117 of the limiting groove 116 to limit the inward pivotal angle of the outer sleeve 2. The limiting block 217 can abut against the second stop wall 118 of the limiting groove 116, and the abutment portion 218 abuts the stopper portion 119, thereby limiting the outward pivotal angle of the outer sleeve 2.

The insertion portion 22 includes an annular wall 221, a bottom wall 222, and an insertion groove 223 formed in a central portion thereof and extending in the vertical direction. A positioning portion 23 is disposed in the insertion groove 223 and extends in the vertical direction. In this embodiment, the positioning portion 23 includes two parallel strips 231 extending from an inner wall of the insertion groove 223 toward a center of the insertion groove 223. Lower ends of the two parallel strips 231 are connected by a connecting plate 232 to form a coupling groove 233 at the lower ends of the two parallel strips 231, providing enhanced coupling. A positioning board 24 is sandwiched between the two parallel strips 231 and includes a lower end positioned in the coupling groove 233. The positioning board 24 can be made of metal or other rigid material. Furthermore, the positioning board 24 includes a plurality of positioning grooves 242 spaced from each other in the vertical direction and facing the center of the insertion groove 223. The insertion portion 22 further includes a passage 25 located at a side of the positioning portion 23 and extending in the vertical direction. The passage 25 is located between outer sides of the strips 231 and the inner wall of the insertion groove 223 and includes an upper end having an opening 251. The insertion portion 22 further includes a connecting hole 26 in communication with an upper portion of the passage 25.

With reference to FIGS. 1, 2, 4, 6, and 7, the cover 3 is mounted above the outer sleeve 2 and includes a top wall 31 and a peripheral wall 32 extending downward along a periphery of the top wall 31 for coupling with a top edge of the insertion portion 22 of the outer sleeve 2. The peripheral wall 32 of the cover 3 includes a connecting hole 321 aligned with the connecting hole 26 of the outer sleeve 2. The top wall 31 includes a through-hole 33 aligned with the insertion groove 223 of the outer sleeve 2. The outer cover 3 further includes a stopper 34 inserted into the opening 251 of the passage 25. The stopper 34 includes a connecting hole 341 aligned with the connecting hole 321. The top wall 31 of the cover 3 includes a through-hole 35 aligned with the polygonal groove 215 of the second upper pivotal plate 211. The nut 219 extends through the through-hole 35. The cover 3 further includes a tab 36 extending downward and aligned with the recessed portion 216. The cover 33 further includes a pressing plate 37 extending horizontally from a lower end of the tab 36. The nut 219 presses against the pressing plate 37.

With reference to FIGS. 1, 2, and 4, the inner sleeve 4 includes a shank 41 at a lower end thereof and a fourth coupling portion 52 at an upper end thereof. The shank 41 is inserted into the insertion groove 223 of the outer sleeve 2. The shank 41 includes an annular wall 41, a bottom wall 412, and a first compartment 413 in a central portion thereof. The first compartment 413 includes an upper opening 414. The annular wall 411 of the shank 41 includes a slot 415 at a lower end thereof corresponding to the positioning portion 23 of the outer sleeve 2. The bottom wall 412 includes an axial hole 416.

The fourth coupling portion 42 is disposed on top of the shank 41 and includes a bottom wall 421 and an annular wall 422. The fourth coupling portion 42 further includes an upper opening 423. A second compartment 424 is located between the bottom wall 421 and the annular wall 422. The bottom wall 421 includes a through-groove 425 aligned with the upper opening 414 of the shank 41. The bottom wall 421 further includes a through-hole 426 at a side of the through-groove 425. The bottom wall 421 further includes a plurality of connecting holes 427 for connection with the control device 5. The fourth coupling portion 42 further includes a plurality of connecting holes 428 for connection with the pad 6.

With reference to FIGS. 1, 2, 3, and 6, the control device 5 includes a coupling board 51, an actuating rod 52, a button 53, and an elastic element 54. The coupling board 51 includes a plurality of connecting holes 511 and is fixed in the second compartment 424. Connecting members 516 extend through the connecting holes 511 of the coupling board 51 and the connecting holes 427 of the fourth coupling portion 42. The coupling board 51 further includes an axial hole 512 in the form of a circular hole having a reduced lower portion. The coupling board 51 further includes two parallel pivotal pieces 513 located at a side of the axial hole 512 and having pivotal holes 514. The coupling board 51 further includes a mounting seat 515 for receiving the elastic element 54.

The actuating rod 52 extends in the vertical direction, is pivotably received in the first compartment 413 of the inner sleeve 4, and includes a rectilinear rod portion 521. A positioning peg 522 is formed on a lower portion of the rectilinear rod portion 521 and extends through the slot 415 of the shank 41 of the inner sleeve 4 for releasably engaging with one of the positioning grooves 242. The positioning peg 522 can be made of metal or other rigid material. The rectilinear rod portion 521 can be made of plastic. The rectilinear rod portion 521 and the positioning peg 522 can be formed by molding injection.

A guiding peg 523 is formed on an upper portion of the rectilinear rod portion 521. The upper portion of the rectilinear rod portion 521 of the actuating rod 52 includes a reduced end 524 having a connecting hole 525 in a central portion thereof. The rectilinear rod portion 521 further includes an axial hole 526 in a central portion of a lower end thereof. The reduced end 524 extends through the axial hole 512 of the coupling board 51. A connecting member 527 is securely engaged in the connecting hole 525 of the reduced end 524. The axial hole 526 of the lower end of the rectilinear rod portion 521 is aligned with the axial hole 416 of the inner sleeve 4 and is pivotably connected by a pin 528.

The button 53 can be pressed to pivot the actuating rod 52 and includes a pivotal hole 531, a guiding portion 532, and a pressing portion 533. The pivotal hole 531 is aligned with the pivotal holes 514 of the pivotal pieces 513. A pin 536 extends through the pivotal holes 531 and 514. The guiding portion 532 includes an inclined guiding groove 534 through which the guiding peg 523 extends. Upward/downward movement of the guiding portion 532 actuates the actuating rod 52 to pivot. The pressing portion 533 extends below the through-hole 426 of the inner sleeve 4 and includes a receiving groove 535 for mounting the elastic element 54.

The elastic element 54 is a compression spring having two ends respectively mounted in the receiving groove 535 of the pressing portion 533 and the mounting seat 515 of the coupling board 51. The elastic element 54 provides the button 53 with operational elasticity. When the pressing portion 533 is not pressed, the positioning member 522 is received in one of the positioning grooves 242. When the pressing portion 533 is pressed, the guiding portion 532 actuates the actuating rod 52 to pivot, and the positioning peg 522 is moved into the passage 25 of the outer sleeve 2, permitting adjustment of a height of the pad 6.

Figure 6:
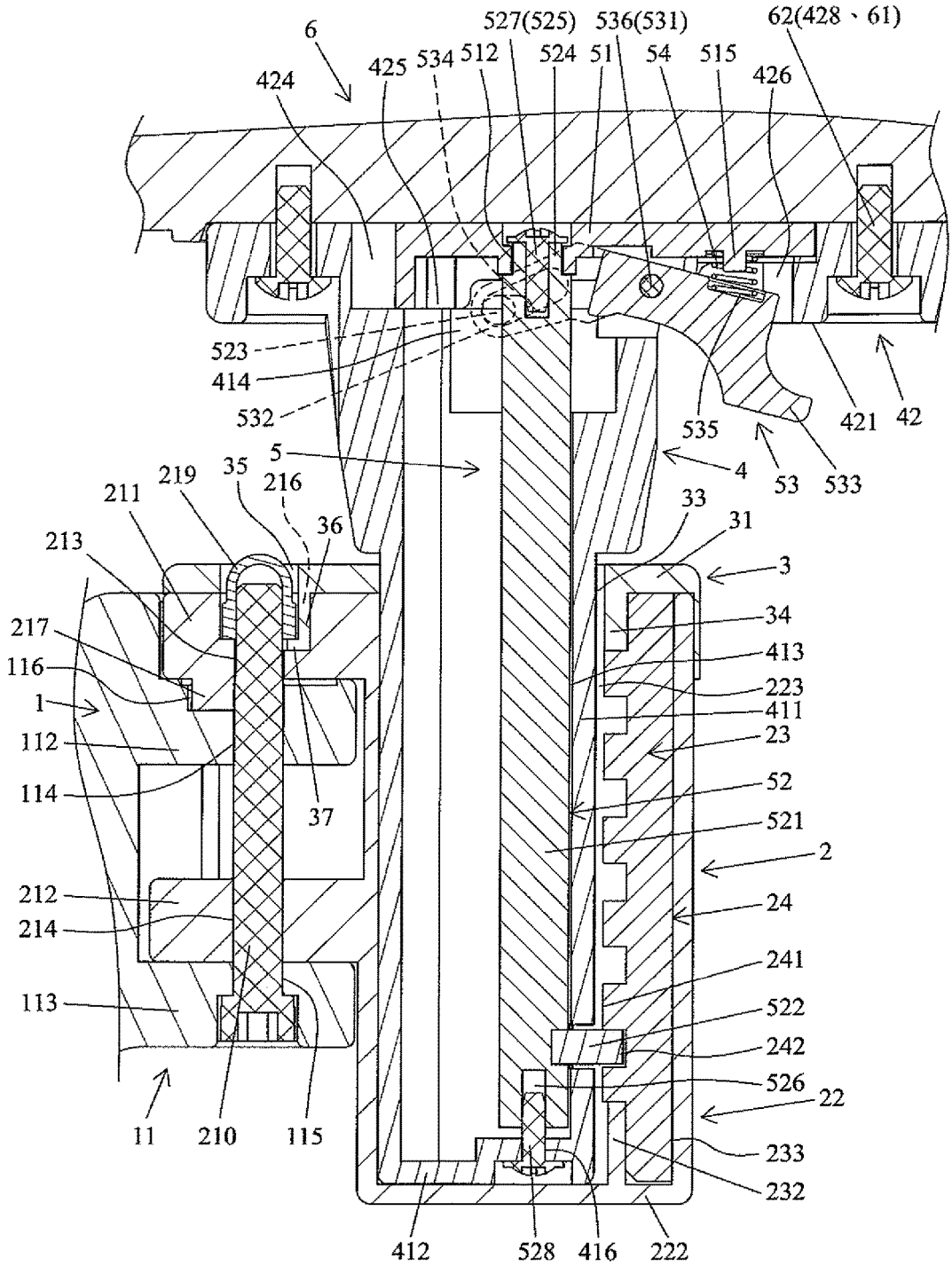
FIG. 6 is a cross sectional view taken along section line A-A of FIG. 5.

The pad 6 is mounted above the fourth coupling portion 42 of the inner sleeve 4 and includes a plurality of connecting holes 61. Fasteners 62 extend through the connecting holes 428 of the fourth coupling portion 42 and the connecting holes 61 of the pad 6, as shown in FIG. 6.

In assembly, the elastic element 54 of the control device 5 is disposed between the mounting seat 515 of the coupling board 51 and the receiving groove 535 of the button 53. The pin 536 extends through the connecting holes 531 and 514 of the button 53 and the coupling board 51. The reduced end 524 of the actuating rod 51 extends through the axial hole 512 of the coupling board 51, and the connecting member 527 engages with the connecting hole 525. The guiding peg 523 is located in the inclined guiding groove 534. The through-hole 33 of the cover 3 receives the shank 41 of the inner sleeve 4. The actuating rod 52 is mounted in the first compartment 413 of the inner sleeve 4. The coupling board 51 is fixed to the fourth coupling portion 42. The axial hole 526 is pivotably connected to the axial hole 416 of the inner sleeve 4. Thus, the actuating rod 52 can pivot stably without deviating from the pivotal axis. Furthermore, the pressing portion 533 of the button 53 is located below the through-hole 426 of the inner sleeve 4, as shown in FIGS. 3 and 6.

Figure 7:
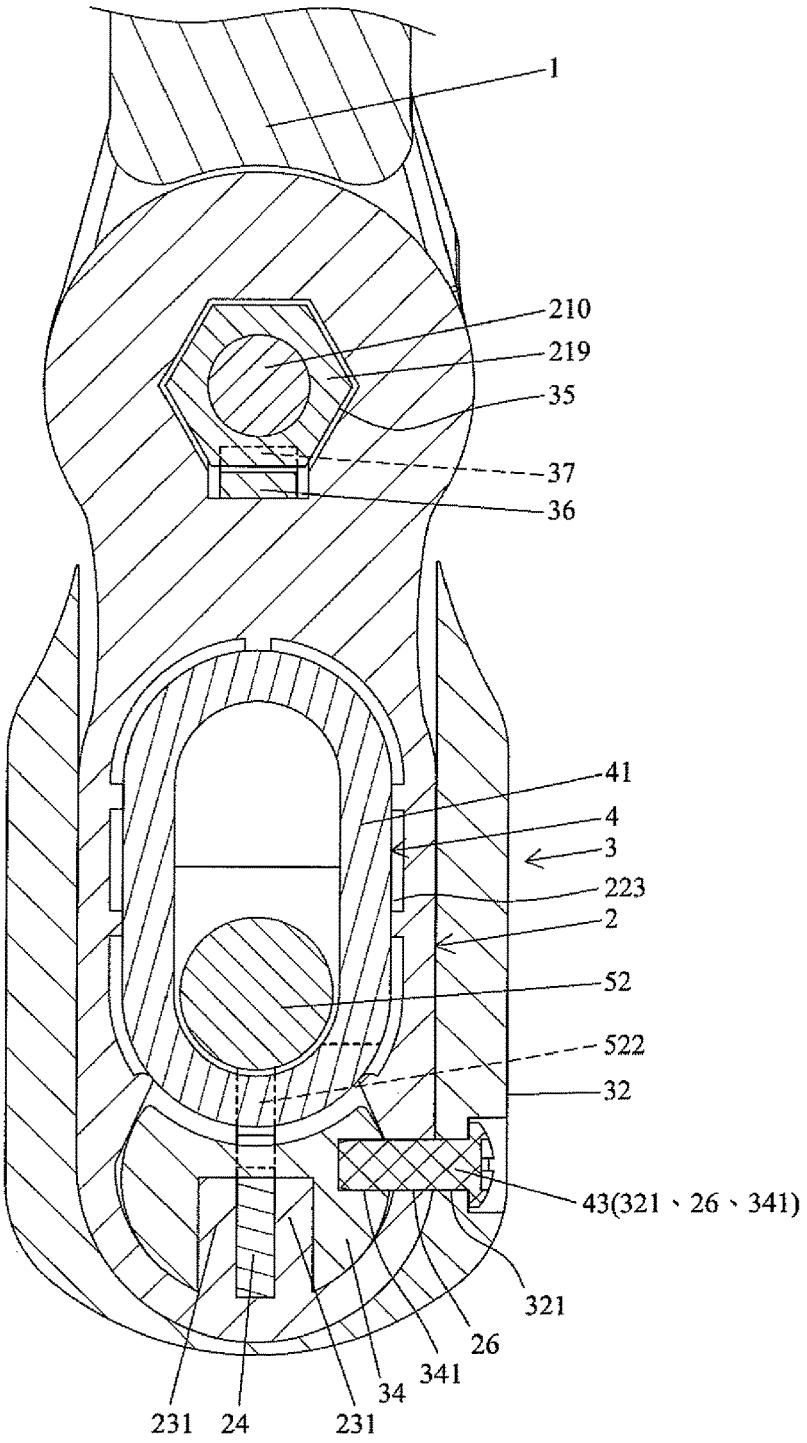
FIG. 7 is a cross sectional view taken along section line B-B of FIG. 5.

During assembly of the outer sleeve 2 and the inner sleeve 4, the button 53 can be pressed to pivot the actuating rod 52. The positioning peg 522 is located in the passage 25 of the outer sleeve 2. Then, the shank 41 of the inner sleeve 4 is inserted into the insertion groove 223 of the outer sleeve 2. Next, the button 53 is released to pivot the actuating rod 52 in the reverse direction, moving the positioning peg 522 into one of the plurality of positioning grooves 242. The cover 3 is coupled to the top of the insertion portion 22. A fixing member 43 extends through the connecting holes 321 of the cover 3, the connecting hole 26 of the insertion portion 22, and the connecting hole 341 of the stopper 34. Thus, the stopper 34 blocks the opening 251 of the passage 25 to avoid the inner sleeve 4 from disengaging from the outer sleeve 2, as shown in FIGS. 7, 8, and 9.

The pad 6 is fixed by the fasteners 62 to the inner sleeve 4. The outer sleeve 2 is coupled to the main frame 1. In assembly, the nut 219 presses against the pressing plate 37 of the cover 3 to securely couple the cover 3 and the outer sleeve 2, as shown in FIGS. 6 and 7.

Figure 8:
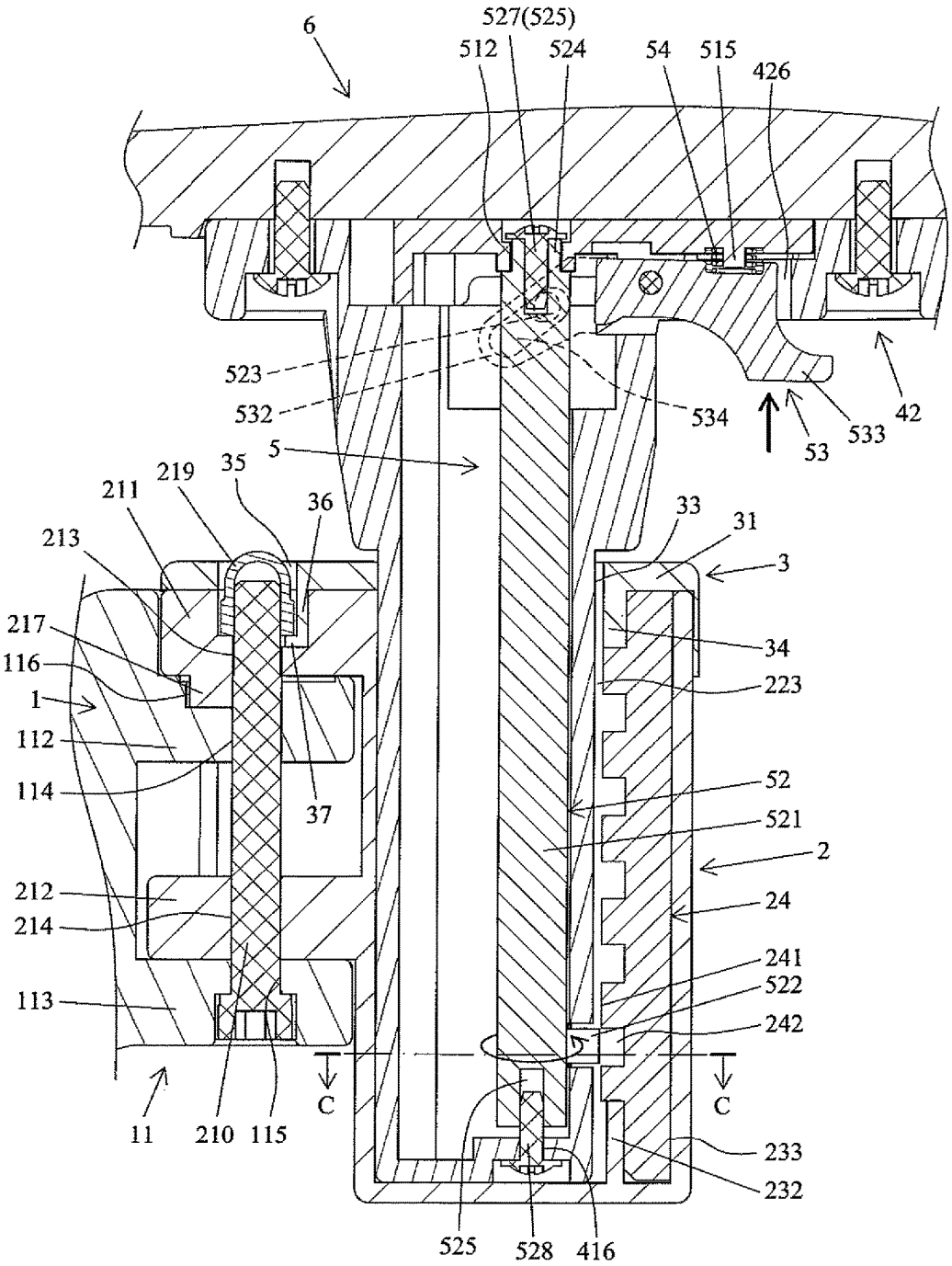
FIG. 8 is a view similar to FIG. 6, with a button pressed.
Figure 9:
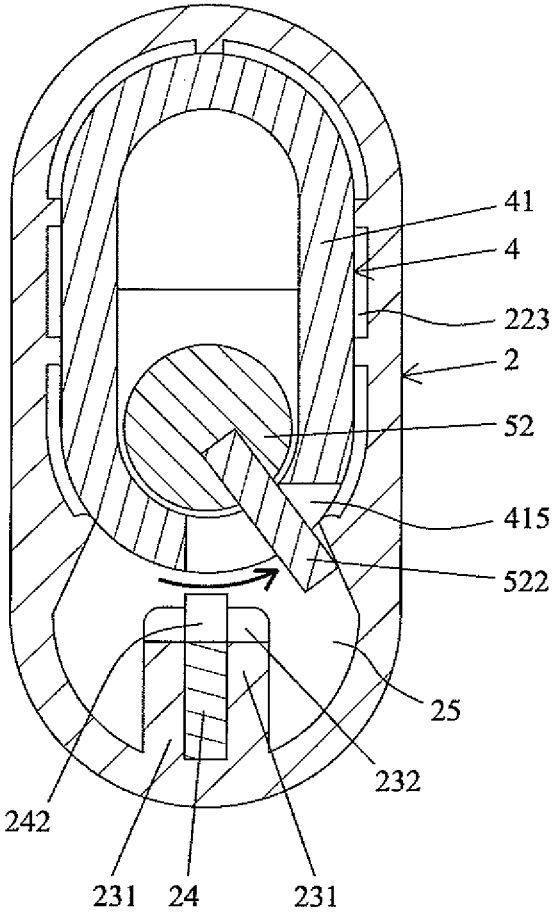
FIG. 9 is a cross sectional view taken along section line C-C of FIG. 8.
Figure 10:
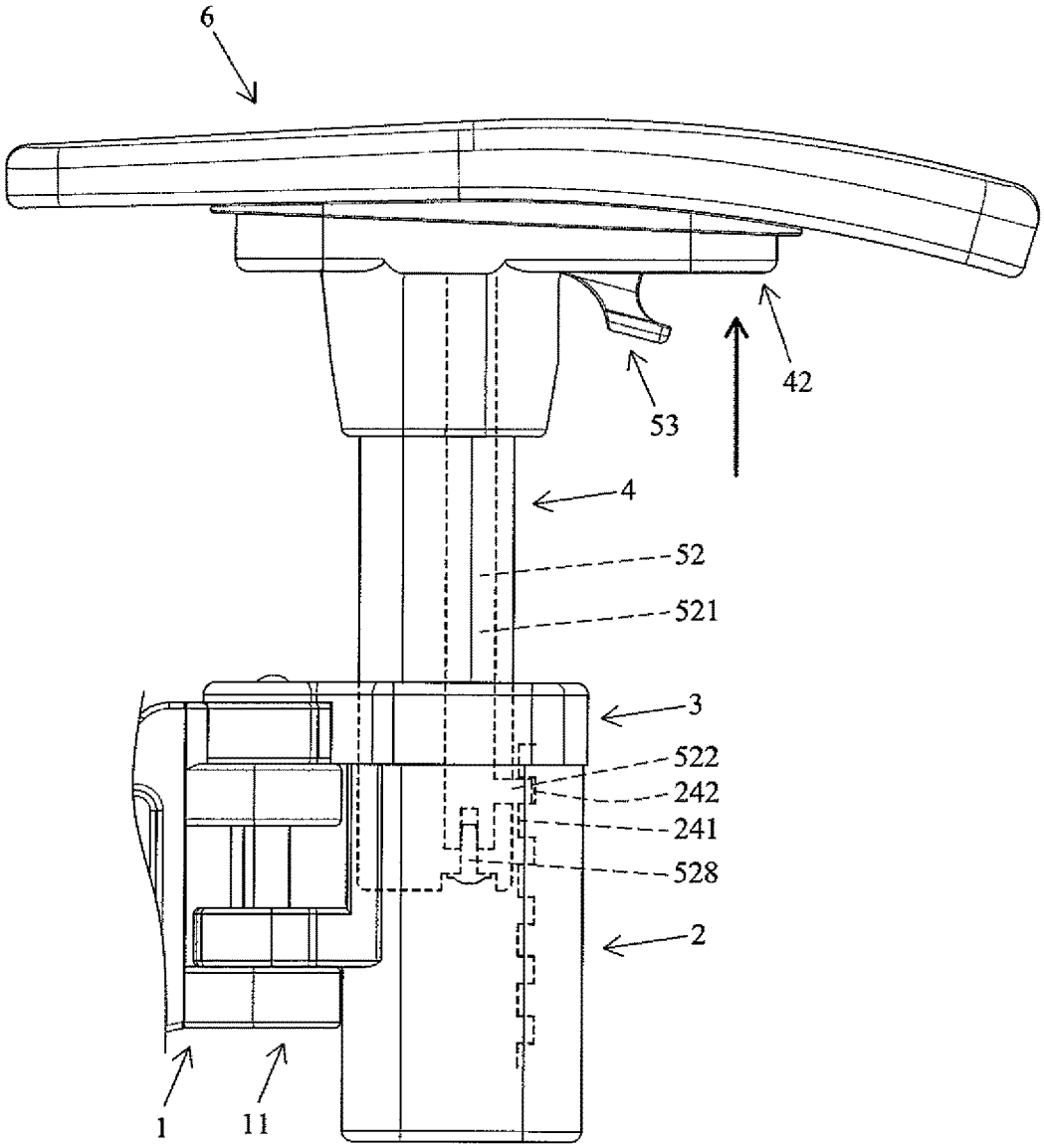
FIG. 10 is a schematic side view illustrating adjustment of a height of a pad of the chair armrest device.

With reference to FIGS. 8 and 9, in adjustment of the height of the pad 6, a user presses the button 53, and the guiding groove 534 of the button 53 moves to pivot the actuating rod 52. Furthermore, the positioning peg 522 pivots to the passage 25 of the outer sleeve 2. Thus, the inner sleeve 4 can move vertically relative to the outer sleeve 2 to adjust the height of the pad 6. After adjustment, the button 53 is released, the elastic force of the elastic element 54 returns the guiding portion 532 and pivots the actuating rod 52 in the reverse direction until the positioning peg 522 engages with one of the positioning grooves 242, providing secure positioning, as shown in FIGS. 6, 8, and 10.

Figure 11:
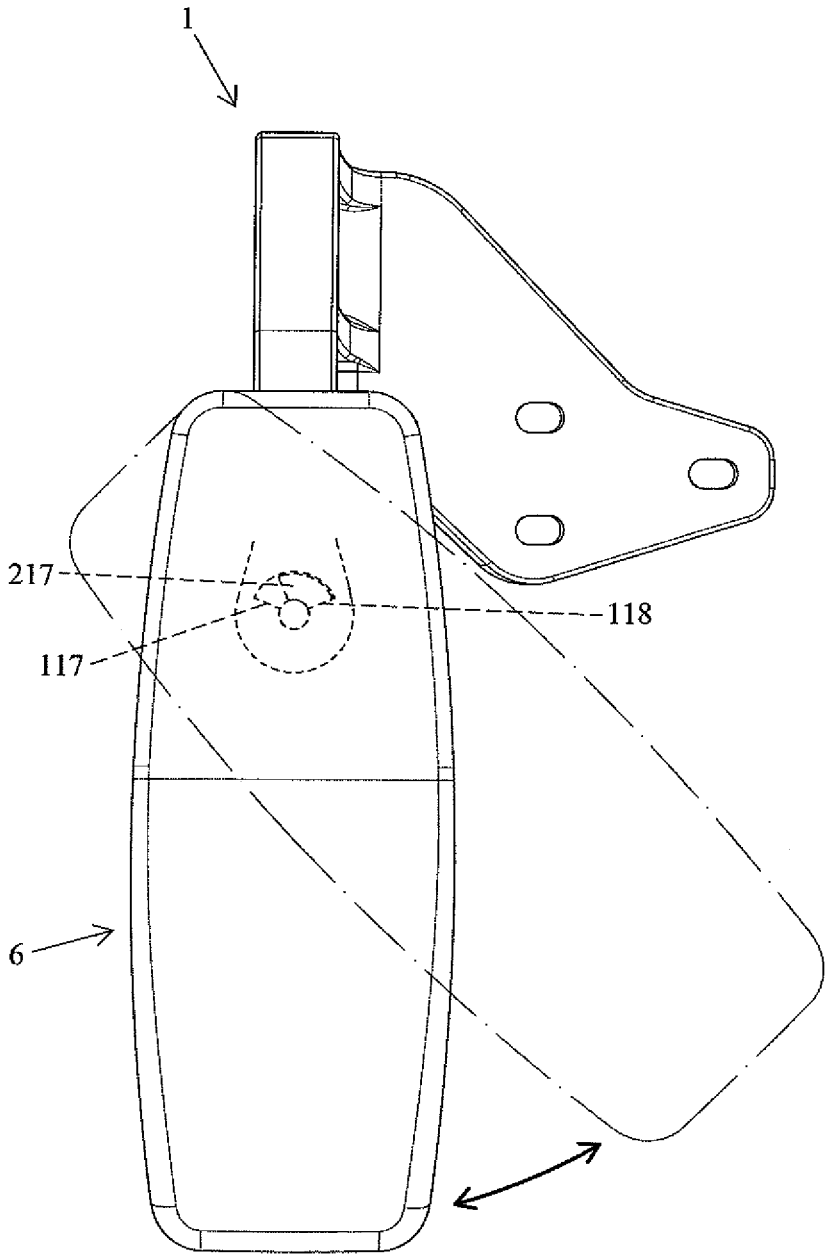
FIG. 11 is a schematic top view illustrating pivotal movement of the pad relative to a main frame of the chair armrest device.

With reference to FIGS. 4 and 11, the pad 6 can pivot relative to the main frame 1 within a predetermined angular range, providing use convenience while operating a mouse (not shown). The limiting block 217 abuts against the second stop wall 118 of the limiting groove 116, and the abutment portion 218 simultaneously abuts against the stopper portion 119, reliably limiting the maximum angular movement of the pad 6 about a vertical axis while providing a better supporting effect. Thus, when the user grips the pad 6 and stands up, the pad 6 will not pivot outward excessively, providing increased supporting reliably and use safety.

In view of the foregoing, the chair armrest device according to the present invention is easy to operate, provides multi-stage height adjustment of the pad 6, provides reliably operation, and provides reliably positioning.

Although specific embodiments have been illustrated and described, numerous modifications and variations are still possible without departing from the scope of the invention. The scope of the invention is limited by the accompanying claims.

The invention claimed is:

1. A chair armrest device comprising:

a main frame including an upper end having a first coupling portion and a lower end having a second coupling portion;

an outer sleeve including a third coupling portion and an insertion portion, wherein the third coupling portion is coupled to the first coupling portion, wherein the insertion portion includes an insertion groove extending in a vertical direction, wherein a positioning portion is disposed in the insertion groove and extends in the vertical direction, wherein the positioning portion includes a plurality of positioning grooves spaced from each other in the vertical direction, and wherein the insertion portion further includes a passage located at a side of the positioning portion and extending in the vertical direction;

a cover mounted above the outer sleeve, wherein the cover includes a top wall and a peripheral wall extending downward along a periphery of the top wall, wherein the top wall includes a through-hole aligned with the insertion groove of the outer sleeve, wherein the outer cover further includes a stopper for blocking the opening of the passage of the outer sleeve;

an inner sleeve including a shank at a lower end thereof, wherein the shank is received in the insertion portion of the outer sleeve, wherein a fourth coupling portion is disposed on top of the shank, wherein the shank includes an annular wall and a bottom wall, wherein the shank further includes a first compartment in a central portion thereof, wherein the annular wall of the shank includes a slot, wherein the fourth coupling portion includes a second compartment;

a control device including a coupling board, an actuating rod, a button, and an elastic element, wherein the coupling board is fixed in the second compartment, wherein the actuating rod extends in the vertical direction and is pivotably received in the first compartment of the inner sleeve, wherein the actuating rod includes a rectilinear rod portion having a lower portion and an upper portion, wherein a positioning peg is formed on the lower portion of the rectilinear rod portion and extends through the slot of the shank of the inner sleeve for releasably engaging with one of the plurality of positioning grooves, wherein a guiding peg is formed on the upper portion of the rectilinear rod portion, wherein the button includes a pivotal hole pivotably connected to the coupling board, wherein the button includes a guiding portion and a pressing portion, wherein the guiding portion includes an inclined guiding groove through which the guiding peg extends, and wherein the elastic element provides the button with operational elasticity; and a pad mounted above the fourth coupling portion of the inner sleeve, wherein when the pressing portion is not pressed, the positioning member is received in one of the plurality of positioning grooves, wherein when the pressing portion is pressed, the guiding portion actuates the actuating rod to pivot, and the positioning peg is moved into the passage of the outer sleeve, permitting adjustment of a height of the pad.

2. The chair armrest device as claimed in claim 1, wherein the positioning portion of the outer sleeve includes a positioning plate, wherein the plurality of positioning grooves is disposed in the positioning plate, wherein the positioning plate and the positioning peg are formed by rigid metal.

3. The chair armrest device as claimed in claim 2, wherein the positioning portion of the outer sleeve includes two parallel strips extending from an inner wall of the insertion groove toward a center of the insertion groove, wherein lower ends of the two parallel strips are connected by a connecting plate to form a coupling groove at the lower ends of the two parallel strips, wherein the positioning board is sandwiched between the two parallel strips and includes a lower end positioned in the coupling groove.

4. The chair armrest device as claimed in claim 2, wherein the actuating rod is made of plastic, and wherein the positioning peg made of metal is integrally formed with the actuating rod.

5. The chair armrest device as claimed in claim 1, wherein the insertion portion of the outer sleeve includes a connecting hole in communication with an upper portion of the passage, wherein the peripheral wall of the cover includes a connecting hole aligned with the connecting hole of the outer sleeve, wherein the stopper extends into the opening of the passage, wherein the stopper includes a connecting hole aligned with the connecting hole of the outer cover, wherein the cover is mounted on top of the outer sleeve, and wherein a fixing member extends through the connecting hole of the insertion portion of the outer sleeve, the connecting hole of the peripheral wall of the cover, and the connecting hole of the stopper.

6. The chair armrest device as claimed in claim 1, wherein the bottom wall of the shank of the inner sleeve includes an axial hole, wherein the coupling board includes an axial hole, wherein the upper portion of the rectilinear rod portion of the actuating rod includes a reduced end having a connecting hole in a central portion thereof, wherein the rectilinear rod portion further includes an axial hole in a central portion of a lower end thereof, wherein the reduced end extends through the axial hole of the coupling board, wherein a connecting member is securely engaged in the connecting hole of the reduced end, wherein the axial hole of the lower end of the rectilinear rod portion is aligned with the axial hole of the inner sleeve and is pivotably connected by a pin.

7. The chair armrest device as claimed in claim 1, wherein the coupling board includes two parallel pivotal pieces having pivotal holes, wherein the coupling board further includes a mounting seat, wherein the pivotal hole of the button is pivotably connected to the pivotal holes of the pivotal pieces of the coupling board, wherein the pressing portion includes a receiving groove, wherein the elastic element is a compression spring having two ends respectively mounted in the receiving groove of the pressing portion and the mounting seat of the coupling board.

8. The chair armrest device as claimed in claim 7, wherein the first compartment of the shank of the inner sleeve includes an upper opening, wherein the fourth coupling portion is disposed on top of the shank and includes a bottom wall and an annular wall, wherein the fourth coupling portion further includes an upper opening, wherein the second compartment is located between the bottom wall and the annular wall, wherein the bottom wall includes a through-groove aligned with the upper opening of the shank, wherein the bottom wall further includes a through-hole at a side of the through-groove, and wherein the pressing portion of the button extends through the through-hole of the bottom wall.

9. The chair armrest device as claimed in claim 1, wherein the first coupling portion of the main frame includes a vertical sidewall, wherein the vertical sidewall includes a first upper pivotal plate and a first lower pivotal plate below and parallel to the first upper pivotal plate, wherein the first upper pivotal plate includes a first pivotal hole in a central portion thereof, wherein the first lower pivotal plate includes a second pivotal hole in a central portion thereof, wherein the first upper pivotal plate includes an upper side having a limiting groove, wherein the limiting groove includes two stop walls on two sides thereof, wherein a stopper portion protrudes from the vertical sidewall for limiting an outward pivotal angle, wherein the outer sleeve further includes a second upper pivotal plate above the first upper pivotal plate of the main frame, wherein the outer sleeve further includes a second lower pivotal plate above the first lower pivotal plate of the main frame, wherein the second upper pivotal portion includes a third pivotal hole in a central portion thereof, wherein the second lower pivotal portion includes a fourth pivotal hole in a central portion thereof; wherein the second upper pivotal plate includes an upper side having a polygonal groove aligned with the third pivotal hole, wherein the second upper pivotal plate further includes a lower side inserted into the limiting groove, wherein a limiting block is formed on the lower side of the second tipper pivotal plate and is movable in the limiting groove, wherein the second lower pivotal plate includes a periphery having an abutment portion for abutting the stopper portion of the main frame, wherein the second upper pivotal plate and the second lower pivotal plate are respectively above the first upper pivotal plate and the first lower pivotal plate, wherein a nut is mounted in the polygonal groove in the upper side of the second upper pivotal plate, wherein an axle extends through the second pivotal hole, the fourth pivotal hole, the first pivotal hole, and the third pivotal hole and engages with the nut, wherein the outer sleeve is pivotable relative to the main frame, wherein the limiting block abuts against the first stop wall of the limiting groove to limit an inward pivotal angle of the outer sleeve, wherein the limiting block abuts against the second stop wall of the limiting groove, and the abutment portion abuts the stopper portion, thereby limiting an outward pivotal angle of the outer sleeve.

10. The chair armrest device as claimed in claim 9, wherein the upper side of the second upper pivotal plate of the outer sleeve further includes a recessed portion located at a side of the polygonal groove, wherein the top wall of the cover includes a through-hole aligned with the polygonal groove of the second upper pivotal plate, wherein the cover further includes a tab extending downward and aligned with the recessed portion, wherein the cover further includes a pressing plate extending horizontally from a lower end of the tab, wherein the nut presses against the pressing plate.

* * * * *